United States Patent [19]

Rosenberg

[11] 4,257,633

[45] Mar. 24, 1981

[54] SECURITY DEVICE

[76] Inventor: Sheldon R. Rosenberg, 2066 E. 23rd St., Brooklyn, N.Y. 11724

[21] Appl. No.: 22,305

[22] Filed: Mar. 20, 1979

Related U.S. Application Data

[62] Division of Ser. No. 637,098, Dec. 2, 1975, abandoned, which is a division of Ser. No. 491,934, Jul. 25, 1974, Pat. No. 3,963,269.

[51] Int. Cl.[3] ..... E05C 19/00

[52] U.S. Cl. ..... 292/304

[58] Field of Search ..... 70/2, 3, 4, 5, 6, 7, 70/8, 9, 10, 11, 12, 13, 102, 103, 104, 105, 106; 292/281, 285, 286, 300, 304, 340, 346

[56] References Cited

U.S. PATENT DOCUMENTS

| | | | |
|---|---|---|---|
| 432,841 | 7/1890 | Seeman | 292/285 |
| 903,647 | 11/1908 | White | 70/13 |
| 1,325,919 | 12/1919 | Voight | 70/106 |
| 1,340,605 | 5/1920 | Gazzi | 292/285 |
| 1,369,937 | 3/1921 | Russakov | 292/285 |
| 1,403,127 | 1/1922 | Segal | 70/106 |
| 1,528,689 | 3/1925 | Phillips | 70/106 |
| 1,529,302 | 3/1925 | Domecq | 292/346 X |
| 1,892,613 | 12/1932 | Edgin | 292/285 X |
| 1,898,391 | 2/1933 | Pressentin | 292/285 |
| 3,761,119 | 9/1973 | Bennett et al. | 292/346 |

FOREIGN PATENT DOCUMENTS

| | | | |
|---|---|---|---|
| 402456 | 4/1909 | France | 292/285 |
| 339556 | 12/1930 | United Kingdom | 292/285 |

*Primary Examiner*—Thomas J. Holko
*Attorney, Agent, or Firm*—Lee C. Robinson, Jr.

[57] ABSTRACT

A security device for preventing unauthorized separation of a door from a cooperating buck assembly, in which first and second plate members are respectively carried by the door and the buck assembly and cooperate with each other to prevent movement of the door in a lateral direction when the door is closed. The first plate member is of unique configuration and is arranged to interlock with adjoining structure on the second plate member to keep the door from moving in its plane. In certain embodiments a Z-shaped support element separate from the plate members is mounted on the buck assembly in juxtaposition with the second plate member, and in some cases either the first plate member or the second plate member includes a pivotally supported cam element which moves into cooperating relationship with the other member as the door reaches its fully closed position.

10 Claims, 18 Drawing Figures

FIG. 11
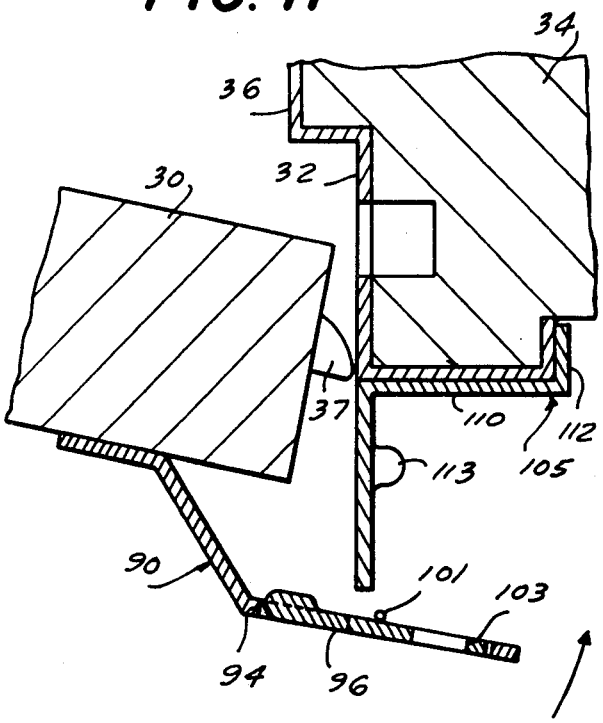
FIG. 12
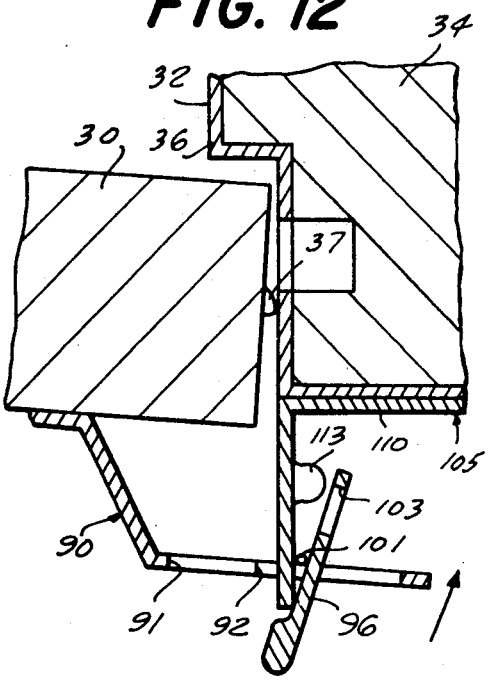
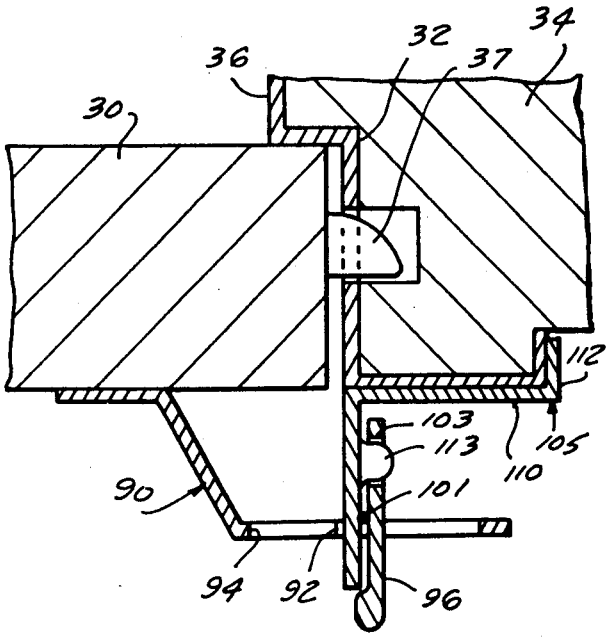
FIG. 13
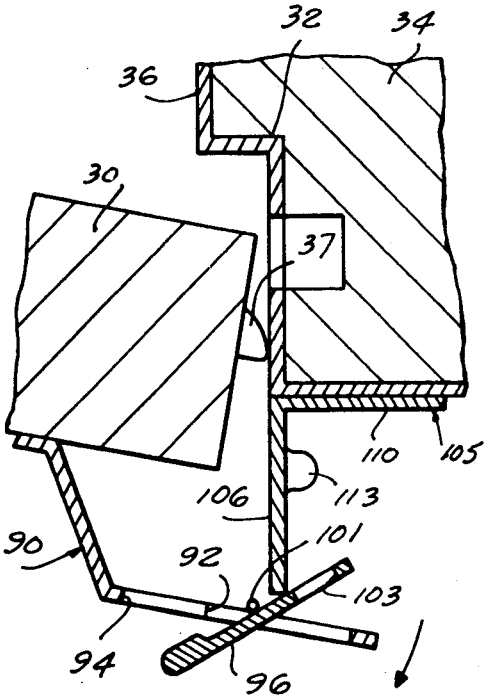
FIG. 14

SECURITY DEVICE

This is a division of application Ser. No. 637,098, filed Dec. 2, 1975, now abandoned in favor of Application Ser. No. 23,269, filed Mar. 23, 1979, which application Ser. No. 637,098 was a division of application Ser. No. 491,934 filed July 25, 1974, now U.S. Pat. No. 3,963,269.

BACKGROUND OF THE INVENTION

This invention relates to security apparatus and more particularly to apparatus for preventing unauthorized separation of a door from a cooperating buck assembly.

As is well known, many types of access doors in present usage are hinged or pivoted along one vertical edge to a cooperating rectangular frame commonly referred to as a door buck. The opposite vertical edge carries a spring biased latch within the door which protrudes into a mating opening in a strike plate on the buck assembly when the door is closed. The latch may be locked to secure the door in its closed position.

One of the ways of gaining unauthorized entry through a door which has been locked in this manner is to wedge a crowbar or similar burglar's tool between the door and the buck assembly and then pry the two apart. The door moves in its plane and becomes bowed sufficiently to carry the latch away from the strike plate by a distance equal to the latch's penetration in the strike plate opening. The door may then be readily moved to its open position.

Although attempts have been made heretofore to prevent such authorized entry through the use of interlocking plates and similar devices, these attempts have proved deficient in many respects. As an illustration, and this was of special moment in the mounting of the plates on a pre-existing door and buck installation, difficulties were encountered in positioning the plates in their proper locations. In addition, in several previous arrangements of this type the apparatus was deficient in providing the desired locking action with the necessary structural rigidity to do a really effective job. Further difficulties were encountered in arranging the interlocking plates such that they remained in position even after successive attempts to force the door.

SUMMARY

One general object of this invention, therefore, is to provide new and improved apparatus for preventing unauthorized separation of a door from a cooperating buck assembly.

More specifically, it is an object of this invention to provide such apparatus which may be readily positioned on a pre-existing door and buck assembly installation.

Another object of the invention is to provide apparatus of the character indicated which exhibits good structural rigidity and remains in position even after repeated attempts to pry the door and buck assembly apart.

A still further object of this invention is to provide a novel security installation of comparatively simple construction which is economical to manufacture and thoroughly reliable in operation.

In one illustrative embodiment of the invention, the apparatus includes a first plate member parallel to and carried by the door and a second plate member carried by the buck assembly in a plane transverse to the door. A latch or other locking mechanism is mounted within the door at the level of the second plate member. The second plate member has a strike portion in position to cooperate with the locking mechanism and an anti-tampering portion which projects beyond the edge of the buck assembly toward the first plate member in coplanar relationship with the strike portion. A vertically extending slot or appropriate structural elements on the first plate member receive the second plate member when the door is closed to prevent movement of the door in its plane. Upon the locking of the door, the locking mechanism remains in cooperating relationship with the strike portion of the second plate member, and cannot be separated therefrom, by bending the door because of the interaction between the plate members.

In accordance with one feature of the invention, in certain particularly important embodiments, a Z-shaped support element separate from the plate members is mounted on the buck assembly in juxtaposition with the second plate member. The support element provides substantial structural rigidity for the anti-tampering portion of the second plate member and is permanently affixed to the buck assembly in a manner such that the element remains in place even after repeated efforts to force the door.

In accordance with another feature of the invention, in several advantageous arrangements, the first plate member extends substantially the entire length of the door in a plane parallel thereto. The first plate member includes a vertically extending slot which is arranged such that the second plate member may be located on the buck assembly in substantially any convenient position without the necessity for precise vertical alignment relative to the slot.

In accordance with a further feature the invention, in some embodiments, either the first plate member or the second plate member is provided with a pivotally mounted cam portion which swings into cooperating relationship with the other plate member as the door reaches its fully closed position. These embodiments enable the realization of extremely effective locking action upon the closing and latching of the door.

The present invention, as well as further objects and features thereof, will be understood more clearly and fully from the following description of certain preferred embodiments, when read with reference to the accompanying drawings.

BRIEF DESCRIPTION OF THE DRAWINGS

FIGS. 11 and 12 are fragmentary horizontal sectional views of the apparatus of FIG. 8 as the door moves toward its closed position.

FIGS. 13 and 14 are fragmentary horizontal sectional views similar to FIGS. 11 and 12 but showing the apparatus as the door moves toward its open position.

DESCRIPTION OF CERTAIN PREFERRED EMBODIMENTS

Figure 1:
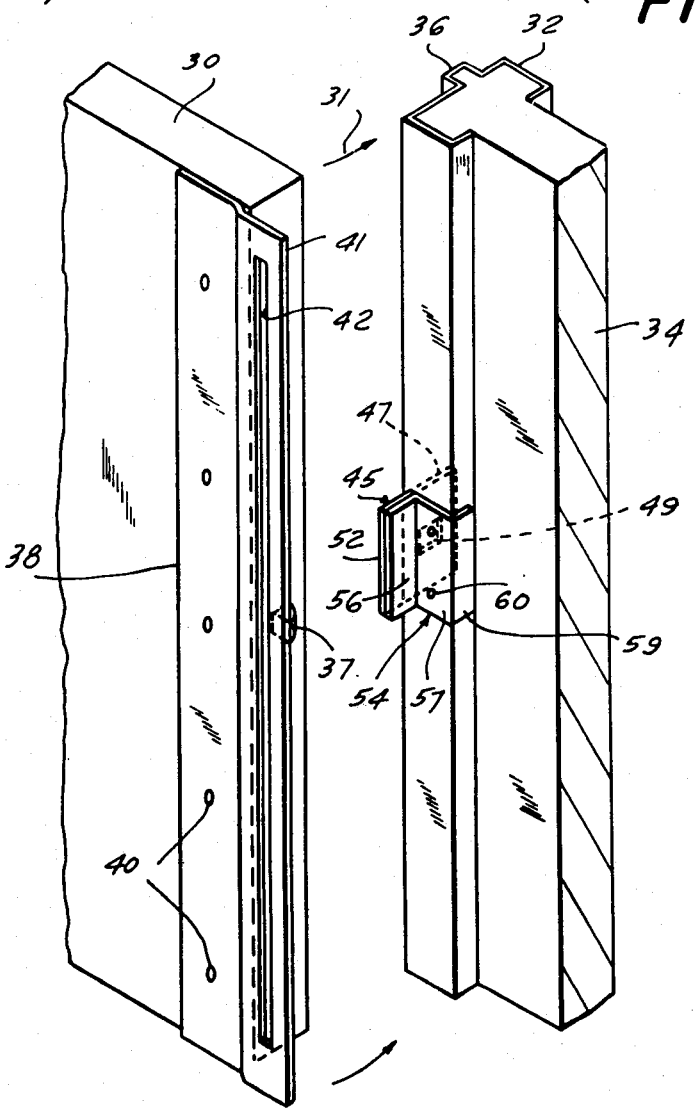
FIG. 1 is a fragmentary perspective view of apparatus for preventing unauthorized separation of a door from a cooperating buck assembly in acccordance with one illustrative embodiment of the invention.
Figure 2:
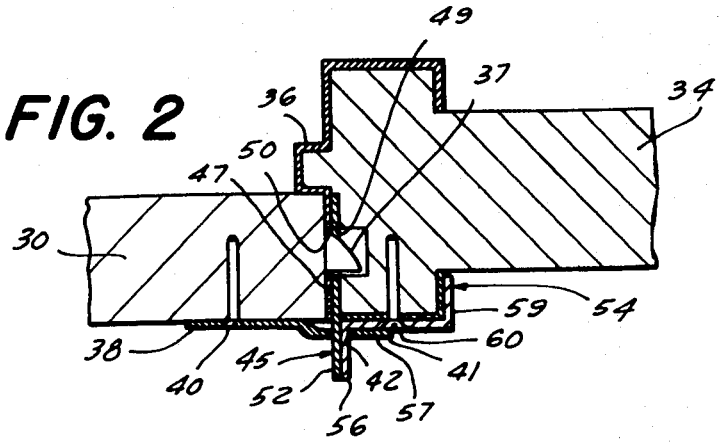
FIG. 2 is a fragmentary horizontal sectional view of the apparatus shown in FIG. 1.
Figure 4:
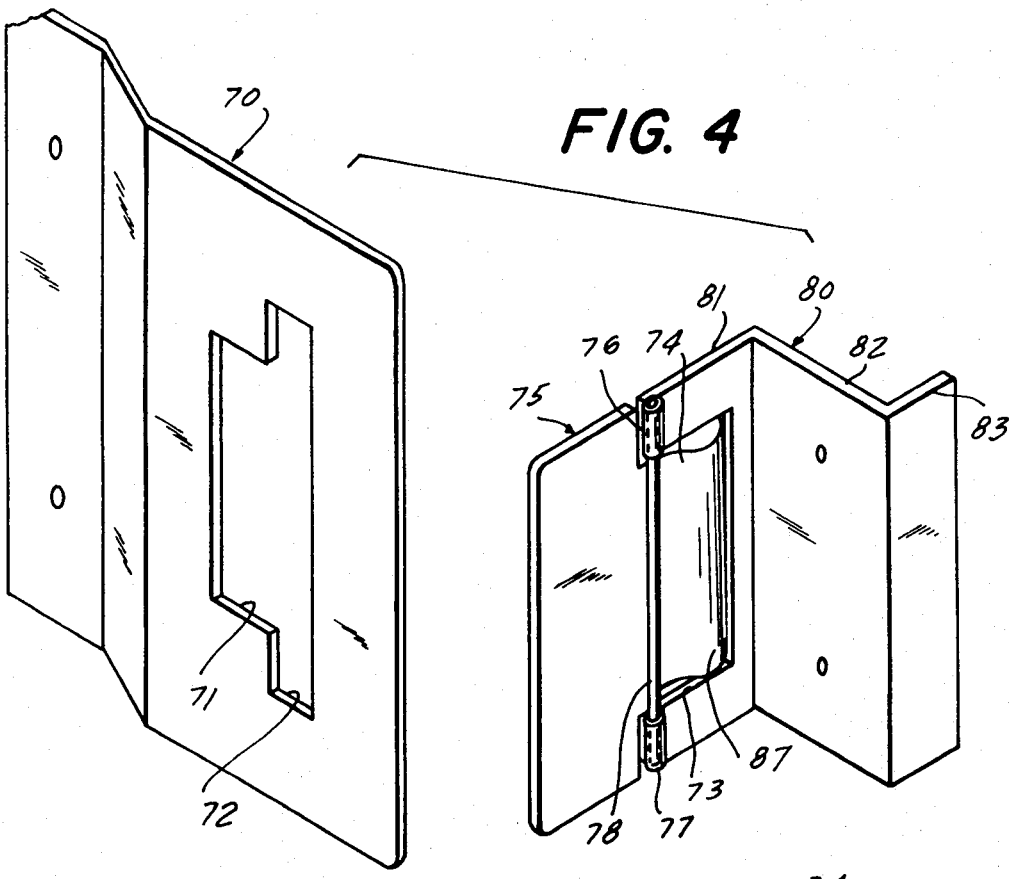
FIG. 4 is a fragmentary perspective view of apparatus for preventing unauthorized separation of a door from a cooperating buck assembly in accordance with another illustrative embodiment of the invention.

Referring to FIGS. 1 and 2 of the drawings, there is shown a door 30 of generally conventional construction. The door 30 is hinged or pivoted along one vertical edge (not visible in the drawings), and its opposite vertical edge is arranged for movement in the direction shown schematically by the arrows 31 toward a cooperating frame or buck assembly 32, only a portion of which is illustrated in the drawings. The illustrated portion of the assembly 32 comprises an upstanding post of rectangular cross-section which may be of sheet metal construction. The post is disposed around the free edge of an interior building partition or wall 34 and includes the usual stop member 36 for the door.

A lock mechanism having a spring-biased latching tongue 37 is recessed within the free edge of the door 30. As will be understood, the tongue 37 may be locked in its extended position when the door is closed through the use of a key or other locking tool.

A vertical door plate 38 is rigidly secured to the free edge of the door 30, as by screws 40. The plate 38 extends substantially the entire length of the door 30 in a plane parallel thereto and is mounted on the door's interior surface, that is, the surfaces within the room or other inclosure. The outboard portion 41 of the plate 38 protrudes a short distance beyond the free edge of the door and is provided with a vertical slot 32. This slot extends substantially the entire length of the plate 38 such that its upper end is located a short distance beneath the ceiling and its lower end is disposed a short distance above the floor.

Recessed in the exposed edge of the buck assembly 32 at the level of the latching tongue 37 is a strike plate 45. The recessed portion 47 of the plate 45 is secured to the buck assembly 32 in the usual way and is provided with an opening 49 in alignment with a mating opening 50 (FIG. 2) in the buck assembly. The openings 49 and 50 are located in position to receive the tongue 37 when the door 30 is in its closed position. The plate 45 additionally includes an anti-tampering portion 52 which projects beyond the edge of the buck assembly 32 toward the door plate 38. The portions 47 and 52 of the plate 45 define a single flat plane which extends in a plane transverse to that of the door and the attached plate 38.

Also mounted on the buck assembly 32 is a Z-shaped support plate 54. The plate 54 is entirely separate from the strike plate 45 but is located in close juxtaposition therewith such that the plate 54 serves as a support for the strike plate. The plate 54 comprises an edge flange 56 in parallel abutting relationship with the anti-tampering portion 52 of the strike plate, an intermediate flange 57 extending in a direction parallel to the door plate 38, and a transverse flange 59 which is spaced from and parallel to the edge flange 56. The intermediate flange 57 is rigidly affixed to the buck assembly by screws 60, and the transverse flange 59 extends around the adjacent corner of the buck assembly such that the plate 54 provides extremely firm support for the anti-tampering portion 52.

To assemble the apparatus on an existing door and buck assembly, the door plate 38 is attached to the free edge of the door 30 by the screws 40, and the vertical slot 42 is aligned with the strike plate 45. This latter plate may be disposed at any convenient height along the buck assembly 32. In cases in which the buck assembly is provided with a conventional strike plate, it is removed and the plate 45 substituted therefor. The Z-shaped support plate 54 is oriented with its edge flange 56 in abutting relationship with the protruding portion 52 of the plate 45 and is secured in place by the screws 60. In some cases one or more additional strike plate and support plate assemblies are added at spaced locations along the length of the buck assembly. The additional plates are similar in construction to the plates 45 and 54, but they need not include the opening 49 for the latching tongue 37.

As the door 30 moves in the direction of the arrows 31 to its closed position, the anti-tampering portion 52 of the strike plate 45, together with the edge flange 56 of the support plate 54, move into the vertical slot 42 in the door plate 38. With the latching tongue 37 locked in its position within the openings 49 and 50, the door may not be opened as long as the tongue 37 remains within these openings. Any attempt to move the door in its plane through a distance sufficient to withdraw the tongue 37 from the openings is prevented by the location of the anti-tampering portion 52 within the slot 42. The portion 42 is positively and firmly supported by the Z-shaped plate 54 with the result that the portion 52 remains within the slot 42 even after repeated efforts to force the door.

Figure 3:
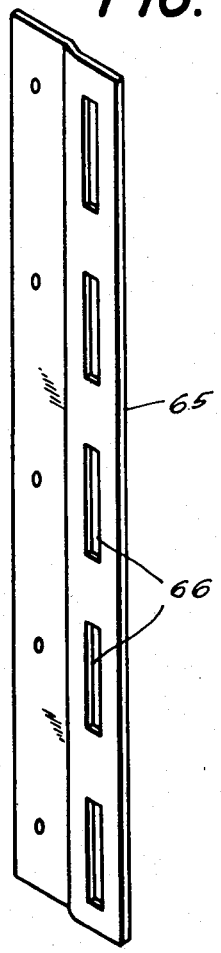
FIG. 3 is a perspective view of an alternative door plate member that may be employed in the embodiment of FIGS. 1 and 2.

FIG. 3 is illustrative of an alternative door plate 65 that may be substituted for the plate 38 of FIGS. 1 and 2. The plate 65 defines a plurality of vertically extending slots 66 which are located in spaced relationship with each other and in vertical alignment with the anti-tampering portion 52 of the strike plate 45. These slots cooperate with the portion 52 and the adjacent flange 56 on the support plate 54 in the manner described above to prevent movement of the door 30 in its plane when the door is in its closed position. The use of an interrupted slot arrangement of the type illustrated in FIG. 3 provides additional structural rigidity but affords slightly less flexibility in the installation of the apparatus on an existing door and buck assembly.

In the embodiments of the invention illustrated in FIGS. 1-3, the door plate extends substantially the entire length of the door from the floor to the ceiling of the enclosure. An advantage of this arrangement is that one or more of the Z-shaped plates 54 may be positioned at a wide variety of locations along the vertical length of the buck assembly 32 depending on the accessibility of the installation and the desired structural rigidity. In cases in which the plate 54 is used without the anti-tampering portion 52 of the strike plate 45, the flange 56 on the plate 54 protrudes through the slot on the door plate to prevent the door from moving in its plane.

In other good embodiments, the apparatus includes a substantially shorter door plate which is approximately coextensive with the cooperating strike plate. Referring to the embodiment of FIGS. 4–7, for example, there is provided a door plate 70 extending along only a small part of the vertical length of the door 30 in a plane parallel thereto. The plate 70 is offset slightly from the plane of the door and includes a vertically extending T-shaped slot 71 having an enlarged opening 72 adjacent the side of the plate away from that affixed to the door.

When the door 30 is in its closed position, the door plate 70 cooperates with a Z-shaped plate 80 to prevent movement of the door in its plane. The plate 80 includes an anti-tampering flange 81, an intermediate flange 82 affixed to the buck assembly 32 and an end flange 83 parallel to the flange 81. A vertically extending slot 73 in the anti-tampering flange 81 accommodates the operating portion 74 of a pivotally mounted element 75. The portion 74 has a curved exterior face which forms a camming surface 87. The flange 81 is of C-shaped configuration with the arms of the "C" forming the upper and lower ends of the slot 73. A pair of vertically aligned tubular members 76 and 77 are respectively located on the arms, and these members receive a pivot rod 78 which is welded or otherwise suitably affixed to the element 75. The element 75 is normally located in coplanar relationship with the flange 81 but is movable about the axis of the rod 78 in a manner that will become more fully apparent hereinafter.

Figure 5:
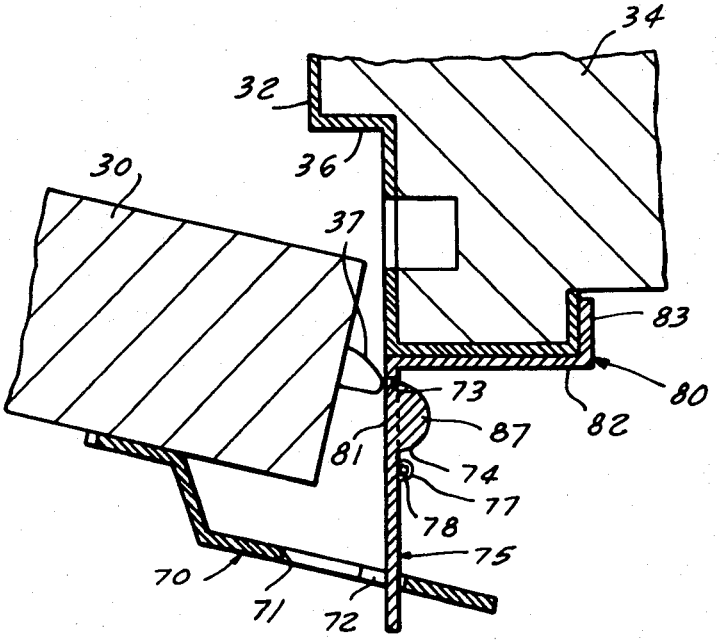
FIG. 5 is a fragmentary horizontal sectional view of the apparatus shown in FIG. 4.
Figure 6:
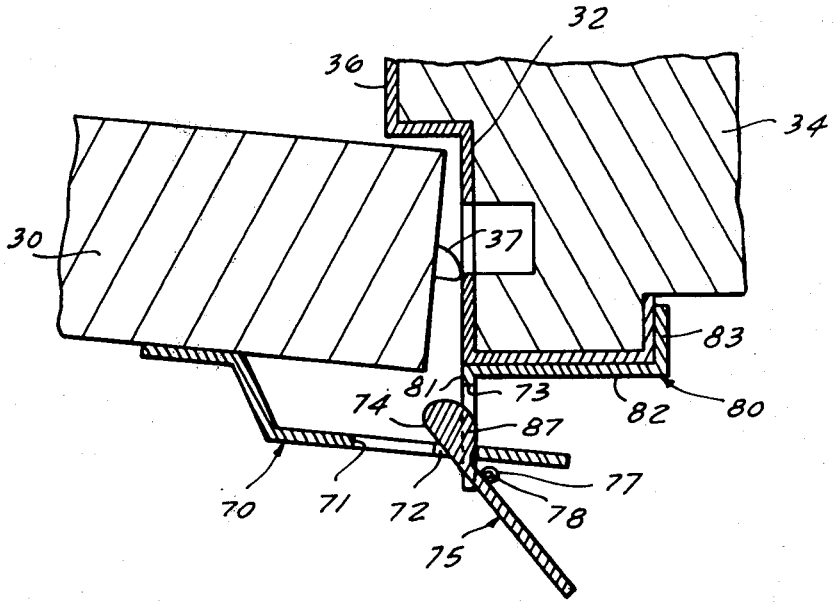
FIGS. 6 and 7 are fragmentary horizontal sectional views similar to FIG. 5 but illustrating successive positions of the apparatus as the door moves to its closed position.
Figure 7:
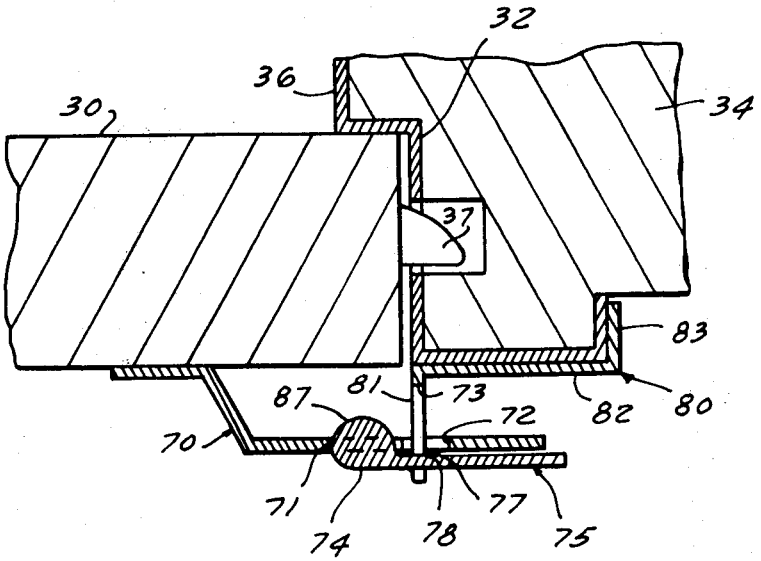
Figure 8:
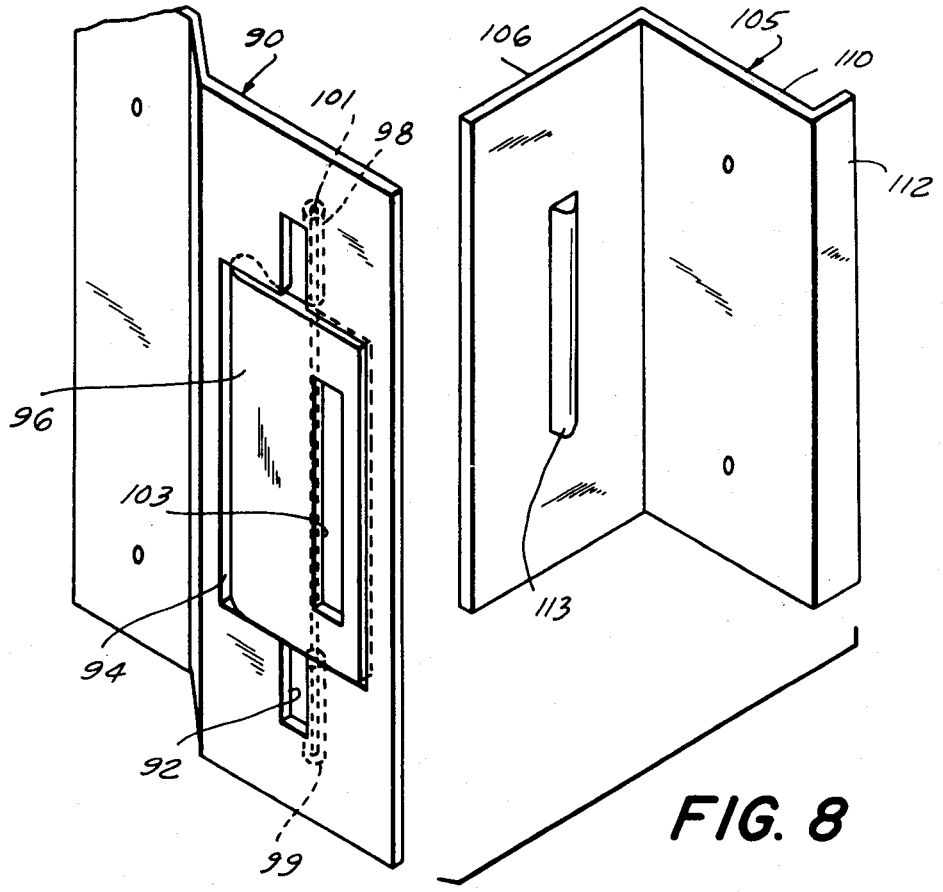
FIG. 8 is a fragmentary perpective view of apparatus for preventing unauthorized separation of a door from a cooperating buck assembly in accordance with a further illustrative embodiment of the invention.
Figure 10:
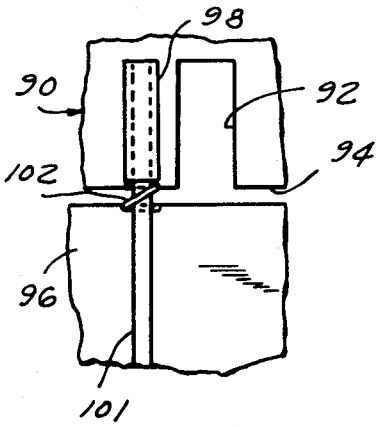
FIG. 10 is a fragmentary rear elevational view of a portion of the apparatus of FIG. 8.
Figure 9:
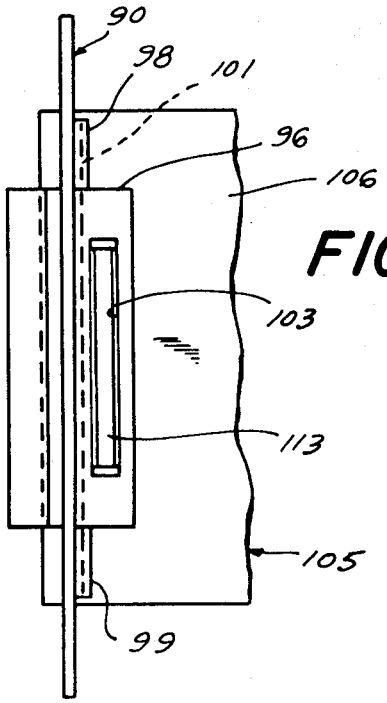
FIG. 9 is a fragmentary side elevational view of the apparatus of FIG. 8 with the door in its fully closed position.
Figure 15:
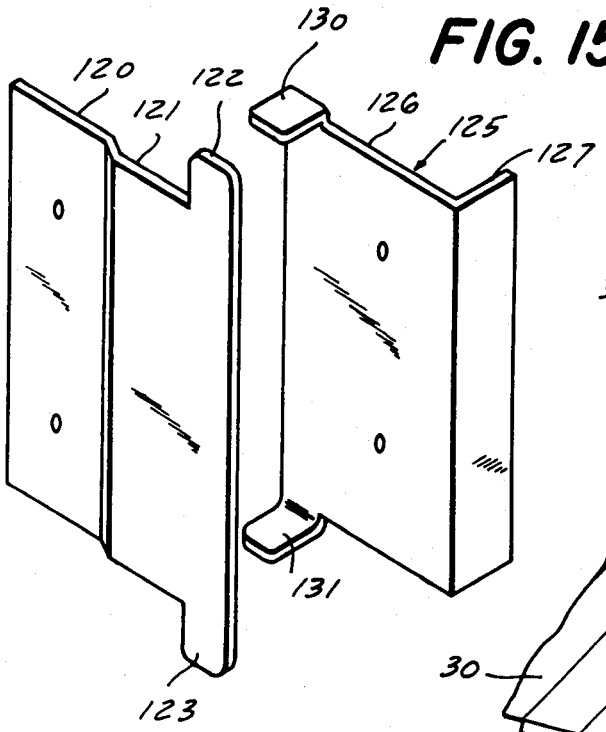
FIG. 15 is a fragmentary perspective view of apparatus for preventing unauthorized separation of a door from a cooperating buck assembly in accordance with still another illustrative embodiment of the invention.
Figure 16:
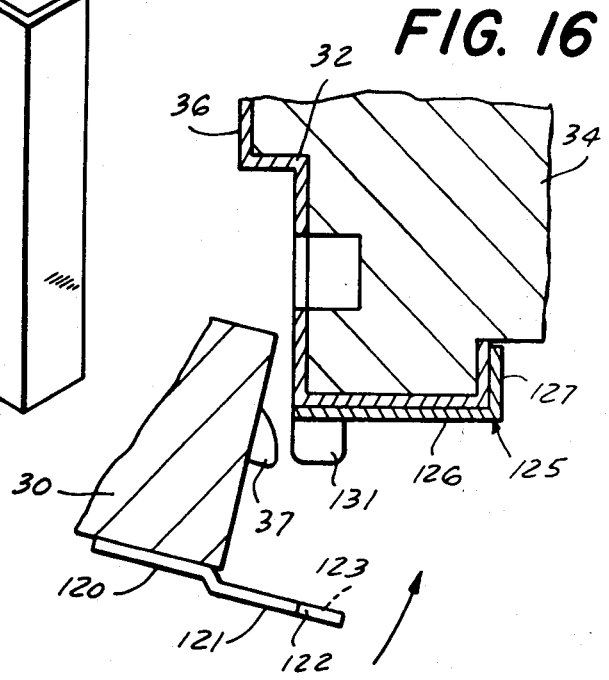
FIGS. 16, 17 and 18 are fragmentary horizontal sectional views of the apparatus of FIG. 15 as the door moves toward its closed position.
Figure 17:
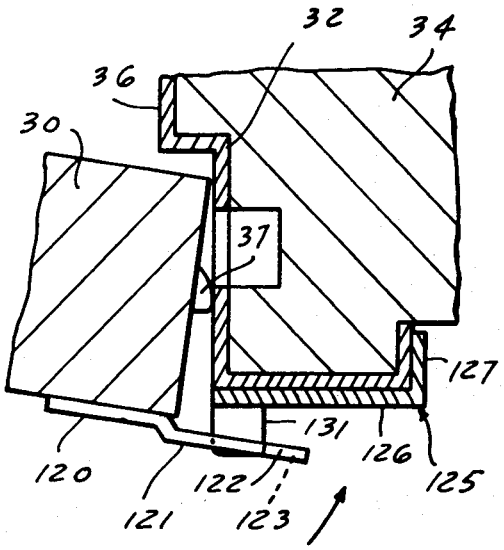
Figure 18:
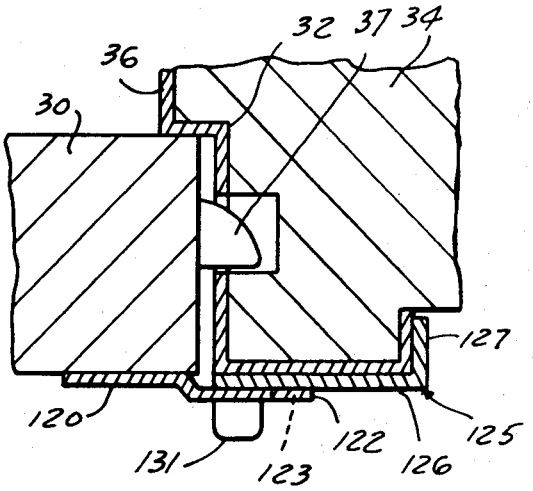

Upon the movement of the door 30 toward its closed position, the anti-tampering element 75 enters the enlarged opening 72 in the door plate 70 in the manner illustrated in FIG. 5. As the door continues its movement and approaches the FIG. 6 position, the edge of the opening 72 engages the camming surface 87 to pivot the element 75 in a counterclockwise direction, as viewed in this Figure, about the axis of the rod 78. When the door reaches its fully closed position (FIG. 7), the element 75 is disposed in the plane of the plate 70 at right angles to its initial position, and the portion 74 of the element 75 is located in the shorter part of the slot 71.

Should an attempt be made to force the door 30 by moving it in its plane, the possibility of such movement is precluded because of the location of the anti-tampering flange 81 of the z-shaped plate 80 within the vertical slot 71 on the door plate 70. When the door is unlocked and moved to its open position, the plate 70 is carried away from the plate 80 to withdraw the anti-tampering flange 81 from the slot 71. The element 75 on the flange 81 returns through a clockwise angle of ninety degrees, as viewed in FIG. 7, to the position illustrated in FIG. 5. In this position the element is again aligned in coplanar relationship with the flange 81.

FIGS. 8–14 are illustrative of another preferred embodiment of the invention. This latter embodiment includes a door plate 90 which is provided with a vertically extending slot 92 communicating with a comparatively large rectangular opening 94. The opening 94 accommodates a pivotally mounted anti-tempering element 96 which is supported by two hinge elements 98 and 99 and a vertically extending pivot rod 101. The elements 98 and 99 are welded or otherwise suitably affixed to the door plate 90 above and below the element 96. The element 96 is urged by biasing springs 102 (FIG. 10) into coplanar relationship with the plate 70 and is provided with a vertical slot 103. The slot 103 extends in a direction parallel to that of the pivot rod 101 on the side of the rod remote from that adjacent the door.

The door plate 90 is located in position to cooperate with a z-shaped plate 105 which is affixed to the buck assembly in a manner similar to that described heretofore. The plate 105 includes an anti-tampering flange 106 which extends in a plane transverse to that of the door, an intermediate flange 110 extending in a direction parallel to the door, and a transverse flange 112 which is spaced from and parallel to the flange 106. The flange 106 is provided with a protruding vertical ridge 113 on its outwardly disposed face of the flange.

As the door is moved toward its closed position, the anti-tampering flange 106 enters the vertical slot 92 in the door plate 90 and engages pivotally mounted element 96. The flange 106 contacts the element 96 a short distance on the inner or left-hand side, as viewed in FIG. 11, of the pivot rod 101, and the element 96 swings in a counterclockwise direction, as seen in this Figure, about the axis of the rod through an angle of approximately ninety degrees. The element 96 moves through the position illustrated in FIG. 12 and comes to rest in the FIG. 13 position with its inner surface in coplanar abutting relationship with the exterior surface of the flange 106. In this position the protruding vertical ridge 113 on the flange 106 is disposed within the vertical slot 103 in the element 96. The door is then locked in the conventional manner to carry the latching tongue 37 into its corresponding opening.

Should an attempt be made to force open the door, the location of the anti-tampering flange 106 within the vertical slot 92 prevents movement of the door in its plane. In addition, slippage between the flange 106 and the element 96 is prevented by the vertical ridge 113 within the slot 103.

To again open the door to obtain authorized entry into the enclosure, the latching tongue 37 is unlocked, and the door is then swung to its open position. As illustrated in FIG. 14, during the initial movement of the door the element 96 pivots in a clockwise direction under the action of the springs 102 (FIG. 10) to carry the slot 103 away from the vertical ridge 113 and to return the element to its initial position in coplanar relationship with the door plate 90.

Referring now to FIGS. 15–18, there is shown still another illustrative embodiment of the invention. The door 30 of these latter figures includes a door plate 120 which extends in a plane parallel to the door and is provided with an offset portion 121 such that the plate is spaced a short distance from the door's inner surface. A pair of ears 122 and 123 are respectively disposed in a single vertical plane on the upper and lower edges of the door plate.

Mounted on the buck assembly 32 is an L-shaped support plate 125. The plate 125 includes a first flange 126 extending in a plane parallel to that of the door plate 120 and a second flange 127 which meets the flange 126 at a right angle. The flange 126 is suitable affixed to the buck assembly 32 and is provided with upper and lower tabs 130 and 131, respectively. These tabs protrude horizontally toward the door plate 120 in positions which just clear the upper and lower edges of the door plate.

As the door 30 swings toward its closed position, the offset portion 121 of the plate 120 moves between the tabs 130 and 131 on the anti-tampering plate 125. In the fully closed position of the door (the position shown in FIG. 18) the ears 122 and 123 are located in close juxtaposition with the respective tabs 130 and 131 on the sides of the tabs opposite those facing toward the door hinge. When the door is locked, any attempt to gain unauthorized entry by forcing the door in its plane brings the ears 122 and 123 into engagement with the adjacent portions of the tabs 130 and 131 and prevents the door from moving a distance sufficient to withdraw the latching tongue 37 from its corresponding opening. The arrangement provides extremely effective locking action upon the closing and latching of the door.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. Apparatus for preventing unauthorized separation of a pivotally mounted door from a cooperating buck assembly, the apparatus comprising, in combination:

a first plate member carried by the door in fixed relationship therewith;

a second plate member carried by the buck assembly and having an anti-tampering portion projecting beyond the edge of the buck assembly toward the first plate member;

means for supporting the second plate member on the buck assembly;

a movable element supported by one of the plate members in position to engage the other plate member;

mounting means on said one plate member normally maintaining the movable element in a first coplanar position with said one plate member and said mounting means further defining an axis parallel to the pivotal axis of said door for supporting said element for pivotal movement about said axis to a second noncoplanar position with respect to said one plate member;

means on one of the plate members for receiving the other plate member when the door is closed; and camming means between said other plate member and said movable element causing said movable element to move to its second position such that the plate members cooperate with each other in the door's closed position to prevent movement of the door in its plane.

2. Apparatus for preventing unauthorized separation of a door from a cooperating buck assembly, the apparatus comprising, in combination:

a first plate member carried by the door and extending in a plane parallel thereto;

a second plate member carried by the buck assembly and having an anti-tampering portion projecting beyond the edge of the buck assembly toward the first plate member;

a movable element pivotally supported by one of the plate members in position to engage the other plate member as the door approaches its closed position;

mounting means on said one plate member normally supporting the movable element in a first coplanar position with said one plate member and said mounting means further defining a vertical axis for supporting the movable element for pivotal movement about said axis through an angle of approximately ninety degrees to a second noncoplanar position with respect to said one plate member; and means defining a vertically extending slot on the first plate member for receiving the anit-tampering portion of the second plate member when the door is closed; and camming means between said other plate member and said movable element causing said movable element to move to its second position such that the plate members cooperate with each other in the door's closed position to prevent movement of the door in its plane.

3. Apparatus for preventing unauthorized separation of a door from a cooperating buck assembly, the apparatus comprising, in combination:

a first plate member rigidly affixed to the door and having a vertically extending slot therein;

a second plate member of Z shaped configuration carried by the buck assembly, the second plate member having an anti-tampering portion projecting beyond the edge of the buck assembly toward the first plate member in position to be received by said vertically extending slot; and a substantially flat movable element supported by one of the plate members in position to engage the other plate member as the door approaches its closed position;

mounting means on said one plate member normally maintaining the movable element in a first coplanar position with said one plate member and said mounting means further defining a vertical axis for supporting said element for pivotal movement about a vertical axis to a second noncoplanar position with respect to said one plate member, the element being in said first coplanar position at all times when the door is open;

the vertically extending slot on the first plate member receiving the anti-tampering portion of the second plate member when the door is closed; and camming means between said other plate member and said movable element causing said movable element to move to its second position such that the plate members cooperate with each other in the door's closed position to prevent movement of the door in its plane.

4. Apparatus for preventing unauthorized separation of a pivotally mounted door from a cooperating buck assembly, the apparatus comprising, in combination:

a first plate member having a fixed portion carried by the door and a movable portion connected to the fixed portion;

a second plate member carried by the buck assembly and extending in a plane transverse to the door, the second plate member having an anti-tampering portion projecting beyond the edge of the buck assembly toward the first plate member in position to engage the movable portion thereof;

means for supporting the second plate member on the buck assembly;

mounting means on said first plate member normally maintaining the movable portion in a first coplanar position with said first plate member and said mounting means further defining an axis parallel to the pivotal axis of said door for supporting said movable portion for pivotal movement about said axis to a second noncoplanar position with respect to said first plate member;

means on one of the plate members for receiving the other plate member when the door is closed; and camming means between said other plate member and said movable portion causing said movable portion to move to its second position such that the plate members cooperate with each other in the door's closed position to prevent movement of the door in its plane.

5. Apparatus for preventing unauthorized separation of a pivotally mounted door from a cooperating buck assembly, the apparatus comprising, in combination:

a first plate member having a fixed portion carried by the door and a movable portion pivotally connected to the fixed portion, the movable portion defining a vertically extending slot therein;

a second plate member carried by the buck assembly and extending in a plane transverse to the door, the second plate member having an anti-tampering portion projecting beyond the edge of the buck assembly toward the first plate member in position to engage the movable portion thereof and pivot the movable portion in a given direction as the door approaches its closed position;

means for supporting the second plate member on the buck assembly;

mounting means on said first plate member normally maintaining the movable portion in a first coplanar position with said first plate member and said mounting means further defining an axis parallel to the pivotal axis of said door for supporting said movable portion for pivotal movement about said axis to a second noncoplanar position with respect to said first plate member;

ridge means on the second plate member in position to extend into the slot in the movable portion of the first plate member when the door is closed; and camming means between said second plate member and said movable portion causing said movable portion to move to its second position such that the plate members cooperate with each other in the door's closed position to prevent movement of the door in its plane.

6. Apparatus as defined in claim 5, in which the movable portion of the first plate member is spring biased into said first coplanar relationship with said first plate member.

7. Apparatus for preventing unauthorized separation of a pivotally mounted door from a cooperating buck assembly, the apparatus comprising, in combination:

a first plate member having a fixed portion rigidly mounted on the door in a plane parallel thereto;

a second plate member carried by the buck assembly and extending in a plane transverse to the door, the second plate member having an anti-tampering portion projecting beyond the edge of the buck assembly toward the first plate member and a movable portion carried by the anti-tampering portion in position to engage the fixed portion of the first plate member;

mounting means on the anti-tampering portion of said second plate member normally maintaining said movable portion in a first coplanar position with said second plate member and said mounting means further defining an axis parallel to the pivotal axis of said door for supporting said movable portion for pivotal movement about said axis to a second noncoplanar position with respect to said second plate member;

means for supporting the second plate member on the buck assembly;

means on the fixed portion of the first plate member for defining a vertically extending slot in position to receive the anti-tampering portion of the second plate member when the door is closed; and camming means between said first plate member and said movable portion causing said movable portion to move to its second position such that the plate members cooperate with each other in the door's closed position to prevent movement of the door in its plane.

8. Apparatus as defined in claim 7, in which the second plate member defines a recess, and the movable portion is pivotally carried within said recess.

9. Apparatus as defined in claim 7, in which the second plate member is of Z-shaped cross-section.

10. Apparatus for preventing unauthorized separation of a door from a cooperating buck assembly, the apparatus comprising, in combination:

locking means for securing the door to the buck assembly;

a first plate member carried by the door in a plane parallel thereto;

a second plate member of Z-shaped cross-section carried by the buck assembly and extending in a plane transverse to the door, the second plate member having an anti-tampering portion projecting beyond the edge of the buck assembly toward the first plate member and a movable portion carried by the anti-tampering portion, the movable portion including a camming surface thereon in position to engage the first plate member as the door approaches its closed position;

mounting means on the anti-tampering portion of said second plate member normally maintaining said movable portion in a first coplanar position with said second plate member and said mounting means further defining a vertical axis for supporting said movable portion for pivotal movement about said axis through an angle of approximately ninety degrees to a second noncoplanar position with respect to said second plate member;

means for supporting the second plate member on the buck assembly; and means on the first plate member for defining a vertically extending slot in position to receive the anti-tampering portion of the second plate member when the door is closed, the first plate member engaging said camming surface as the door approaches its closed position to move said movable portion to its second position such that the plate members cooperate with each other in the door's closed position to prevent movement of the door in its plane.

* * * * *